United States Patent [19]

Grasset

[11] Patent Number: 4,577,632

[45] Date of Patent: Mar. 25, 1986

[54] ARTICLE FOR INFANTS, FORMING PACIFIER AND TEETHING RING SIMULTANEOUSLY

[76] Inventor: Joseph Grasset, Ecole Publique de Saint-Vidal, FR 43320 Loudes, France

[21] Appl. No.: 577,649

[22] Filed: Feb. 6, 1984

[30] Foreign Application Priority Data

Feb. 10, 1983 [FR] France ..... 83 02444

[51] Int. Cl.[4] ..... A61J 17/00

[52] U.S. Cl. ..... 128/360; 128/359

[58] Field of Search ..... 128/150, 359, 360; D24/45

[56] References Cited

U.S. PATENT DOCUMENTS

| | | | |
|---|---|---|---|
| 1,656,833 | 1/1928 | Schutze | 128/359 |
| 4,324,249 | 4/1982 | Sundkvist et al. | 128/360 |
| 4,381,785 | 5/1983 | Robbins | 128/360 |
| 4,447,164 | 8/1984 | Berndt | 128/359 |
| 4,481,949 | 11/1984 | Kesselring et al. | 128/360 |

FOREIGN PATENT DOCUMENTS

| | | | |
|---|---|---|---|
| 2657817 | 6/1978 | Fed. Rep. of Germany | 128/360 |

*Primary Examiner*—Gene Mancene
*Assistant Examiner*—John G. Weiss
*Attorney, Agent, or Firm*—Dowell & Dowell

[57] ABSTRACT

The present invention relates to an article for infants, forming a pacifier and a teething ring at the same time, wherein the open base of the pacifier teat is fixed by a ring in one of the two annular parts of a flange piece, the second part forming the teething ring and a ring for retaining and gripping. The opposite faces of the flange piece comprise sectioned projections similar to those of a conventional teething ring. A stopper occupies the center of the annular part which supports the teat and is adapted to constitute a one-way air valve thereinto.

5 Claims, 2 Drawing Figures

ARTICLE FOR INFANTS, FORMING PACIFIER AND TEETHING RING SIMULTANEOUSLY

The present invention relates to two different types of articles for infants, on the one hand, a pacifier or comforter and, on the other hand, a teething ring. The former is simply intended to occupy the infant's mouth by offering him something to suck, whilst the function of the latter is to promote teething after the infant has been weaned.

In conventional pacifiers, the open base of the teat is directly fixed to an enlarged flange adapted to limit penetration thereof in the mouth, and it is closed by a ring disposed so that its axis is oriented perpendicularly to the common axis of the teat and the flange, said ring allowing the article to be gripped and possibly allowing passage of a tie or other fastening. In practice, the two separate pieces are assembled together by adhesion and it is readily understood that, in the event of untimely disconnection, for example following a series of sterilizations by scalding, the infant risks swallowing one or the other of the two pieces.

Furthermore, it will be recalled that teething rings at present on the market are most often made of natural rubber with a high Shore hardness, much different from that of the rubber used for making pacifiers, such hardness being indispensable if it is desired to promote cutting of the teeth and to calm the irritation of the gums.

It is an object of the present invention to provide an article for infants adapted to form a combined pacifier and teething ring, thus performing two functions which are complementary whilst being different, said article in addition strangly avoiding any risk of disconnection of its constituent elements whilst remaining capable of being sterilized in boiling water.

The article according to the invention is essentially noteworthy in that the teat, made separately from the flange, is rendered mechanically fast with the latter, which presents two annular parts of parallel axes, at least one of the faces of these two parts bearing sectioned projections similar to those of a teething ring.

The invention will be more readily understood, and other features of the article according to the invention relative more particularly to the mode of fixing the open base of the teat on the flange and to the closure of this base, will be seen from the following description with reference to the accompanying drawings, in which.

Figure 1:
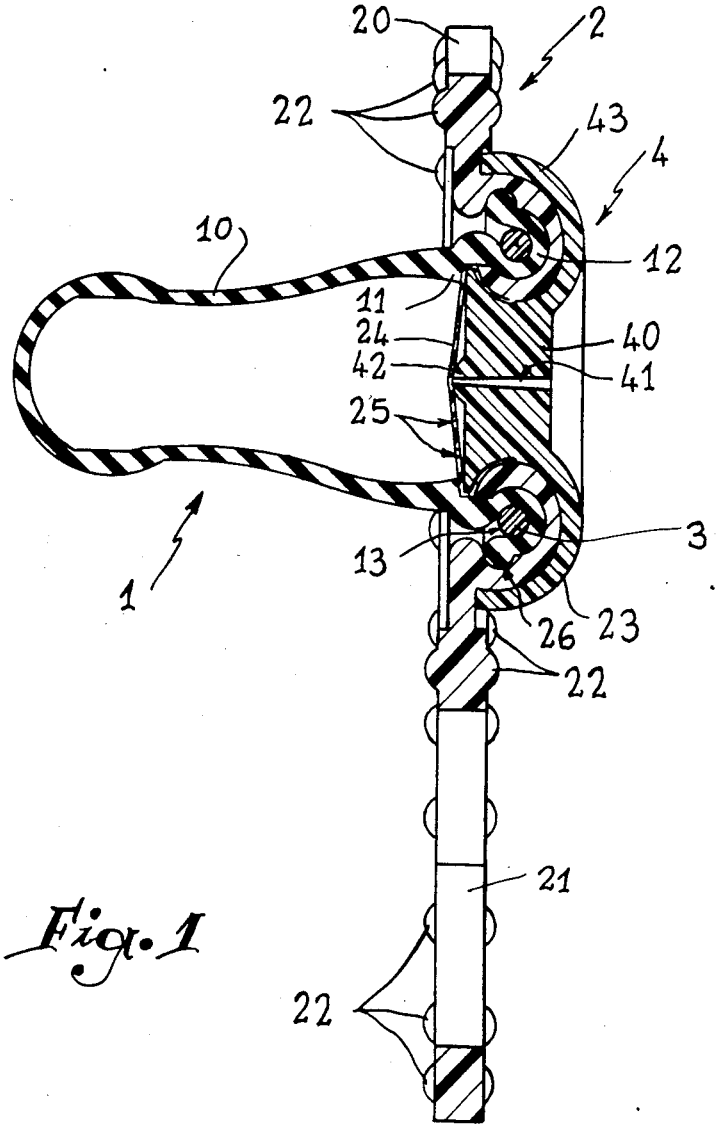
FIG. 1 is an axial cross section through an article according to the invention.
Figure 2:
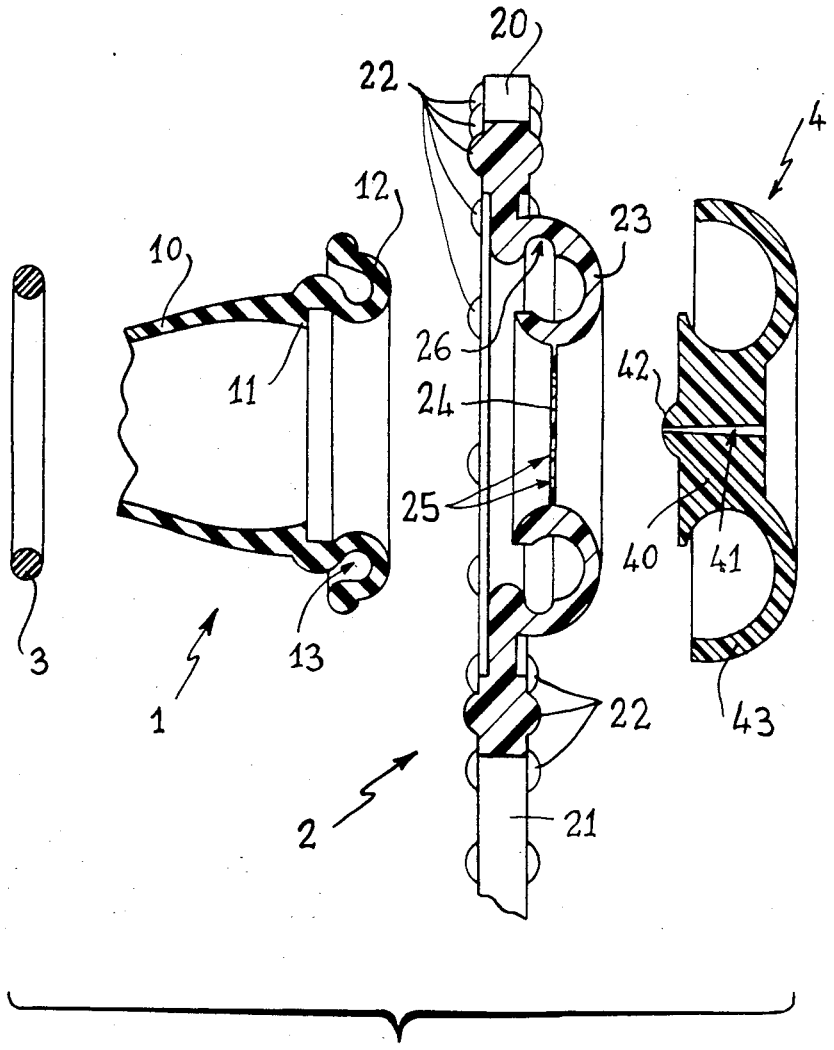
FIG. 2 is an exploded similar view, showing the four elements constituting this article, prior to assembly thereof.

Referring now to the drawings, the article according to the invention firstly comprises a teat 1, advantageously made by moulding pure rubber having optimum suppleness for the use envisaged. The open base of the body 10 of this teat 1 comprises an inner annular shoulder 11 adapted to form a stop, as will be seen hereinafter, and it is extended by a bead 12 sectioned so as to define an incompletely closed groove 13.

The teat 1 is associated with a teething ring flange piece 2, preferably made of moulded rubber of an appropriate Shore hardness, different from that of said teat. This piece 2 presents two annular parts 20 and 21 with parallel axes, disposed tangentially to each other; the two opposite faces of these parts 20 and 21 comprise projections 22 identical to those of a conventional teething ring.

The inner edge of the annular flange part 20, adapted to form a flange for the teat 1, is fixed to an extension 23 in the form of an annular dish portion whose central opening is closed by a thin, circular, elastically deformable membrane 24; this membrane 24 is pierced with a series of perforations 25 but not in its central part. It will be observed that the inner wall of the extension or dish 23 has an annular groove 26 made therein.

The article according to the invention further comprises, in addition to an assembly ring 3 constituted by a simple closed ring, a stopper 4 which is made of moulded plastics material. The body 40 of this stopper is pierced with an axial channel 41 of conical section, the opening of said channel of smaller diameter being located in a semi-spherical bulge 42. The body 40 carries on its periphery a part 43 in the form of an annular dish.

FIG. 1 shows that the elements are shaped and dimensioned so that the bead 12 of the base of the teat 1 clips inside the dish 23, so that definite connection is ensured by the ring 3 engaged in the groove 13 in said bead, the thickened free edge of which is itself housed in the groove 26. The dish 23 is in turn contained in the annular part 43 of the stopper 4, the stopper being engaged by force in the opening of the dish 23 until it abuts against the shoulder 11 of the base of the body 10 of the teat 1. The effect of this force-fit is to push and stretch the central member 23 whose membrane is applied against the bulge in the inner face of the stopper.

The assembly ensured by ring 3 is safe from any risk of untimely disconnection. The article produced combines to a certain extent the specific functions of pacifiers and teething rings, it being observed that, by making pieces 1 and 2 separately, materials of different consistencies and colours can be employed; the combination of the pacifier and the teething ring makes it easier for the infant to stop using the pacifier at the time when the teething ring is particularly useful and to which he is already accustomed, thus avoiding any perturbation.

It will also be noted that the perforated membrane 24 and the channel 41 constitute a sort of one-way valve which opposes any leakage of air through the stopper 4, whilst allowing admission, inside the body 1 of the teat, of the quantity of air for compensating the inevitable losses of air through the wall of the body under the effect of repeated mastications thereof, consequently avoiding any permanent deformation of the teat.

What is claimed is:

1. A pacifier article for infants, comprising:

an annular flange part having an opening therethrough;

a hollow elastic teat body closed at one end and having an opening through its other end, the teat body entering the opening in the flange part and having its opening registering therewith;

a stopper having an axial channel therethrough, the stopper passing through the flange part and entering the teat body through its opening, with the channel in communication with the hollow teat body;

means for retaining the teat body and the flange part and the stopper mutually assembled; and one-way valve means cooperatively associated with the channel through the stopper and operative to resist the passage of air outwardly from the hollow teat body through the channel but to freely admit air from the channel into the hollow teat body.

2. A pacifier article as claimed in claim 1, wherein said one-way valve means comprises a thin elastically deformable membrane within said openings and disposed across the stopper, one part of said membrane covering said channel, and the membrane being perforated at other parts thereof which are displaced from said channel.

3. A pacifier article as claimed in claim 2, wherein said stopper has an inner face disposed toward the inside of the teat body, and the inner face having a semi-spherical bulge through which said channel extends, the bulge lying against the membrane, and the perforations in the membrane being located radially outwardly of the bulge.

4. A pacifier article as claimed in claim 1, wherein the teat body has a bead extending therearound defining said opening, and the bead having an annular groove therein; the flange part having an annular dished portion around its opening shaped to receive said bead; said retaining means comprising an annular ring receivable in said groove in the bead to enlarge the bead and retain it within said dish portion; and the stopper having means for entering the opening in said teat body and having means for surrounding said annular dish portion to retain the stopper fixed to the teat body and the flange part.

5. A pacifier article as claimed in claim 4, wherein said flange part has a second annular part disposed tangentially to said dish portion of the flange part and comprising a teething ring, the axes of the teething ring and of the opening in the flange part being mutually parallel.

* * * * *